United States Patent [19]

Laedtke et al.

[11] 4,007,772

[45] Feb. 15, 1977

[54] APPARATUS FOR VACUUM PRECISION CASTING

[76] Inventors: Donald O. Laedtke, 2400 W. Roberts Ave.; Myron W. Jackson, 430 S. Christine, both of Appleton, Wis. 54911

[22] Filed: Nov. 6, 1974

[21] Appl. No.: 521,272

[52] U.S. Cl. ..... 164/151; 164/255; 164/55

[51] Int. Cl.[2] ..... B22D 27/16

[58] Field of Search ..... 164/61, 62, 253, 254, 164/255, 65, DIG. 4, 151; 425/388

[56] References Cited

UNITED STATES PATENTS

| | | | |
|---|---|---|---|
| 1,046,976 | 12/1912 | Cogswell | 164/255 X |
| 1,186,558 | 6/1916 | Dunn | 164/151 |
| 1,424,595 | 8/1922 | Schwartz et al. | 164/255 |
| 1,489,761 | 4/1924 | Heidbrink | 164/151 |
| 1,494,869 | 5/1924 | Sweetnam | 164/62 |
| 2,482,257 | 9/1949 | Frei, Jr. | 164/65 X |
| 2,877,523 | 3/1959 | Turnbull | 164/65 |
| 2,926,385 | 3/1960 | Willson, Jr. | 425/388 X |
| 2,931,064 | 4/1960 | Matoba | 425/388 |
| 3,234,604 | 2/1966 | Anderson | 164/255 |
| 3,692,088 | 9/1972 | Kulig | 164/DIG. 4 X |
| 3,712,364 | 1/1973 | Daniel et al. | 164/4 |
| 3,741,281 | 6/1973 | Hauser-Lienhard | 164/253 |

FOREIGN PATENTS OR APPLICATIONS

| | | | |
|---|---|---|---|
| 2,116,425 | 1/1972 | Germany | 164/253 |

OTHER PUBLICATIONS

"Vacuum-Forming Sheet Plastic", *Popular Mechanics*, Dec., 1961, pp. 174, 176, 177.

*Primary Examiner*—Ronald J. Shore
*Attorney, Agent, or Firm*—Andrus, Sceales, Starke & Sawall

[57] ABSTRACT

A portable vacuum investment casting apparatus includes a box-like housing having an upper generally flat supporting wall with a vertical conduit terminating in an opening in the top wall. A vacuum conduit is connected to the vertical conduit and terminates in an outer sidewall in large and small conical connectors to receive a conventional shop or household vacuum cleaner hose. A manually adjustable valve is connected in an exhaust pipe from the vacuum conduit for controlling the vacuum level. The apparatus is powered from a conventional household type vacuum cleaner device or similar fan unit which establishes a relatively high air flow with a relatively low vacuum. A small vacuum gauge tube is mounted on the front wall adjacent to the vacuum setting control. The top end is connected to the vertical conduit and the lower end has a supply tube with an adjustable end member to set the initial liquid level. The housing is provided with a power cable connected to a kiln outlet and a vacuum cleaner outlet by corresponding switches. The heated investment is placed on the top wall and molten metal poured into the cavity with the vacuum cleaner source turned on to remove air and gases from within the cavity.

10 Claims, 4 Drawing Figures

APPARATUS FOR VACUUM PRECISION CASTING

BACKGROUND OF THE INVENTION

The present invention is directed to precision casting wherein an investment mold is formed from an expendible pattern.

Precision casting or molding is employed to form products which generally require minimal final finishing. Such castings are well-known in the precision arts such as precision engineering, clock work, dental and precious metal ornamentations. A wax-like expendible pattern is made directly or from the master mold. The expendible pattern is then encased in a wet slurry or paste consisting of a suitable fine grain refractory mold material and a bonding agent such as a plaster of paris. The coating closely envelops the expendible pattern reproducing essentially each and every detail of its shape and configuration. The mold material is solidified to form a mold or investment with the pattern invested in place. The investment is then heated or otherwise treated to remove the expendible pattern and to define a hard and strong mold. The final cast product is immediately formed while the investment is hot by introduction of the metal into the mold and filling the mold. Generally, under the broad field of investment molding, the metal may be introduced under gravity pressure and even in some cases under centrifugal means. Finally when the metal has solidified, the mold is removed or broken away, leaving the final product with the highly finished surface.

The investment casting may advantageously employ a vacuum chamber within which the mold is located during the filling of the expendible mold. Various vacuum systems have been suggested wherein a suitable cup-shaped enclosure is provided within which the expendible porous investment is placed. A relatively high vacuum pump is coupled to the chamber to establish the usual relatively high pressure vacuum on the order of barometric pressure and with a minimum of air flow. For example, U.S. Pat. No. 3,780,781 which issued Dec. 25, 1973, discloses an investment casting system wherein a porous mold is formed in accordance with any conventional practice and then placed within special enclosure with an automatic upper sealing wall to define a relatively closed encircling vacuum chamber. The chamber is connected to the conventional vacuum pump source widely employed in vacuum investment casting. With the heat investment located within the chamber, the vacuum pump is operated to draw a full vacuum after which the casting material is introduced into the mold.

Although such special apparatus has been widely employed in precision casting, there is a significant need for a simple, reliable investment casting apparatus which can be employed in the home, school and small business to permit forming of precious metal ornaments, dental bridges, crowns and the like as well as the hobbyist for making small cast objects such as gears or inexpensive ornaments.

SUMMARY OF THE PRESENT INVENTION

The present invention is directed to a small, portable controlled vacuum investment casting apparatus which is particularly adapted to the manufacture of small objects such as ornaments, dental components and hobby type components. Generally, in accordance with the present invention, a small investment casting support is provided having a vacuum connection and an upper supporting wall upon which the investment can rest. The apparatus is powered from a conventional household type vacuum cleaner device or similar fan unit which establishes a relatively high air flow with a relatively low vacuum. The apparatus is conveniently constructed with an adjustable relatively large hose-like adapter adapted to receive several conventional vacuum hose sizes. This provides a very simple, convenient and inexpensive apparatus which can be readily adapted to small domestic, institutional and business operations. This particularly adapts the invention to the student and hobbyist as well as the relatively small professional operation which requires only intermittent use of the investment casting apparatus.

More particularly in accordance with a particularly novel construction of the present invention, the apparatus includes a small box-like housing having an upper generally flat supporting wall, with a small central opening. A fluid tight conduit means is coupled to the opening and terminate in an outer sidewall in a vacuum supply pipe connector. A control pipe is coupled to the vacuum supply pipe with a manually adjustable exhaust valve for adjusting the setting of the valve and thereby controlling the vacuum level established at the centrol control opening. Applicants have found that with the use of a high flow and low level vacuum source such as a vacuum cleaner, the upper wall can be an essentially flat wall with the vacuum applied only through the bottom or lower portion of the porous investment or mold. The heated investment is removed directly from the kiln and placed in a heated condition upon the flat upper surface of the housing with the investment generally overlying the opening. The molten metal is then poured directly into the void with the high flow source turned on and maintained on at least for a few seconds prior to and for a minute or more after the pouring. Applicants have found that the upper wall opening with the investment resting thereon results in an essentially complete removal of air and gases from within the mold and thereby prevents oxidizing of the mold material and forming of air bubbles at the surface thereof.

A small vacuum gauge in the form of a simple liquid containing tube member is preferably mounted on the front wall adjacent to the vacuum setting control with the upper end of the member connected to the vacuum pipe adjacent the opening. An adjustable end member is coupled to the lower end of the tube to vary the starting position of the liquid column. A uniform numbered scale on the housing adjacent the liquid column indicates the vacuum setting. The electrical control for the kiln and the vacuum cleaner or the like high flow source may be conveniently provided on the housing and connected to suitable wiring to provide for control of the vacuum supply and the kiln from a single unit.

BRIEF DESCRIPTION OF THE DRAWING

The drawing furnished herewith illustrates a preferred construction of the present invention in which the above advantages and features are clearly disclosed as well as others which will be readily understood from the description of the illustrated embodiments.

In the drawing.

DESCRIPTION OF THE ILLUSTRATED EMBODIMENT

Figure 1:
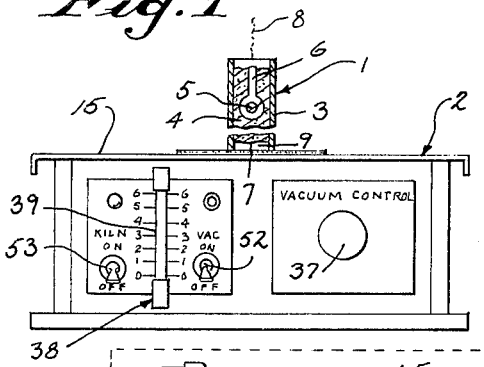
FIG. 1 is a front elevational view of an investment casting apparatus constructed in accordance with the present invention and with an investment in place.

Referring to the drawing and particularly to FIG. 1, a mold or investment unit 1 is shown supported on the upper surface of an investment casting apparatus 2 constructed in accordance with the present invention. The investment unit 1 is shown as a cylinder of investment including an open-ended outer metal cylinder 3 filled with a plaster-of-paris material or any other suitable material which develops a porous investment 4 within which a cavity 5 is formed with a top filling sprue 6. The apparatus 2 is particularly adapted to generate a high flow, low level vacuum on the underside 7 of the investment 4 during the introduction of a molten metal 8 into the cavity 5. In accordance with conventional practice, the investment unit 1 is formed by supporting of a pattern replica of the final object to be formed within a suitable tubular enclosure or cylinder 3. A sprue-forming closure, not shown, is attached to close the bottom of cylinder 3 with the pattern supported thereon. The cylinder 3 is then filled with plaster-of-paris 4, preferably below the top edge of cylinder 3 to define a lower chamber 9 when assembled as in FIG. 1. The filled cylinder is placed in a kiln 10 and heated to a suitable temperature to burn away or otherwise remove the replica. This results in hardening of the investment and forming of a void or cavity 5 within the investment 4 which is a duplicate having essentially exact dimensions and surface detail of the original pattern. By filling of the investment cavity 5 with a suitable molten metal and ensuring that the metal firmly moves into engagement with the surface of the cavity 5 to eliminate voids and the like, an extremely similar duplicate of the original object is created. In order to properly develop a final product, care must be taken to eliminate gases from within the mold cavity 5 during the casting process. Generally, it has been known to mount the investment 4 within a vacuum apparatus to remove such gases. The present invention provides a novel means for insuring removal of gases from within the mold cavity to thereby insure a highly finished final product. Generally, in accordance with the present invention, apparatus 2 is powered from a high flow, low level vacuum source such as a conventional vacuum cleaner unit 11.

Figure 2:
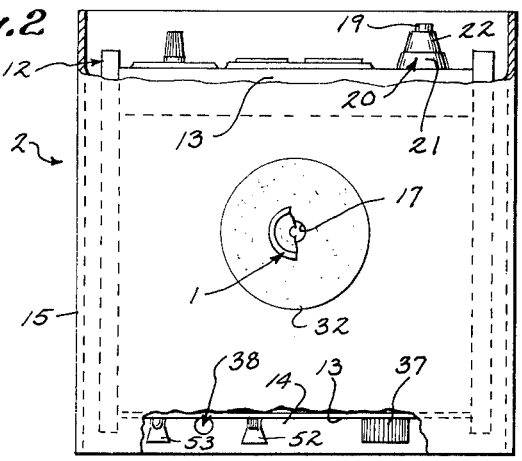
FIG. 2 is a top elevational view of the casting apparatus shown in FIG. 1 with the investment removed.
Figure 3:
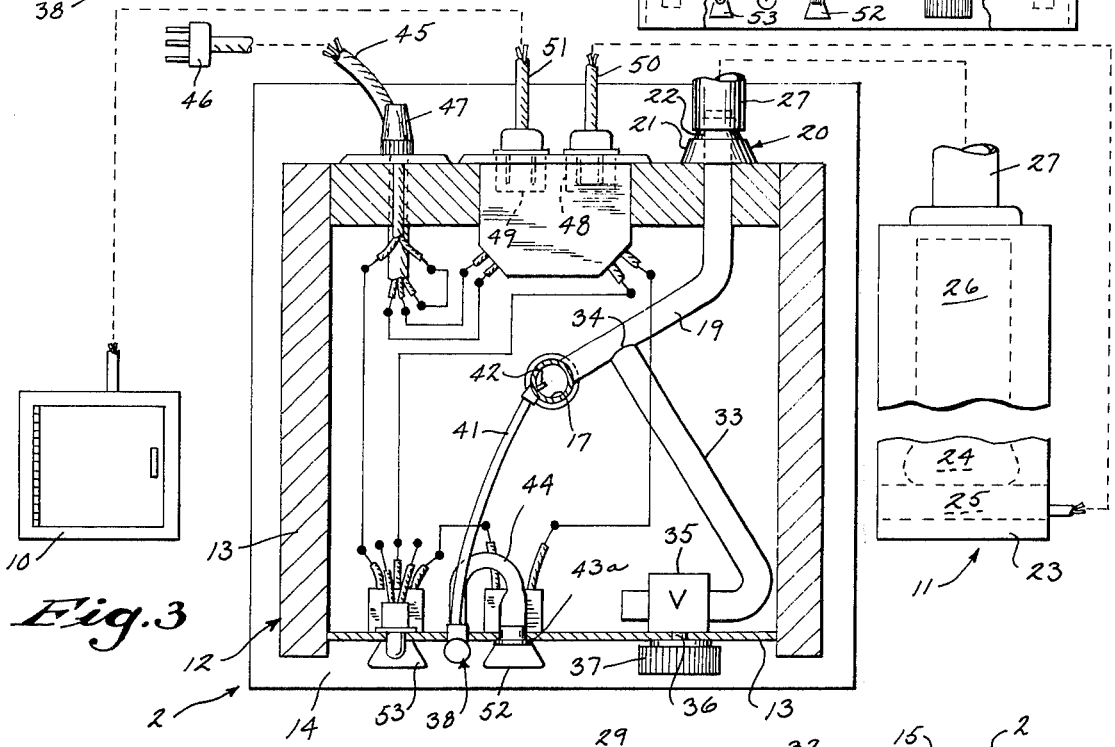
FIG. 3 is a view similar to FIG. 2 with the upper wall broken away to more clearly illustrate the internal construction of the vacuum casting apparatus.

Referring to FIGS. 2 and 3, the illustrated embodiment of the apparatus of the present invention includes a box-like enclosure or housing 12 having a rectangular sidewall 13 connected to a flat supporting bottom wall 14 and a flat top wall 15. The top wall 15 is formed as a generally flat, planar surface with a central opening 16 somewhat smaller than the diameter of the minimum investment to be employed with the apparatus and, in a unit for hobbyists, jewelers and the like, may be conveniently about a three-quarter inch opening. A pipe or conduit 17 terminates within the opening and extends downwardly within the housing to a lower, removable cap 18. A vacuum conduit 19 is connected to the conduit 17 above the cap and exists through the back side wall 13. A vacuum cleaner adapter 20 is secured to the outer projecting end of the conduit 19. The illustrated adapter 20 is formed as a stepped member defining a pair of slightly conically-shaped elements 21 and 22 corresponding to the inner diameters of the generally conventional industrial vacuum cleaner hose and a conventional household vacuum cleaner hose, respectively. The illustrated cleaner unit 11 is shown including a portable tank 23 within which the usual motor 24 and blower 25 are mounted relative to a receiver 26. A hose 27 is releasably secured to the tank 23 and terminates at the outer end in a tubular coupling end. A household hose 27 is conventionally formed with an inner diameter of about one inch and may be readily applied by merely telescoping of the free end over the projecting outer element 22 of the adapter 20. The adapter 20 is shown including individual elements 21 and 22 which slip-fit over conduit 19. An extra small diameter adapter will normally be provided as certain household cleaner hoses are of one and one-half inch diameter.

Figure 4:
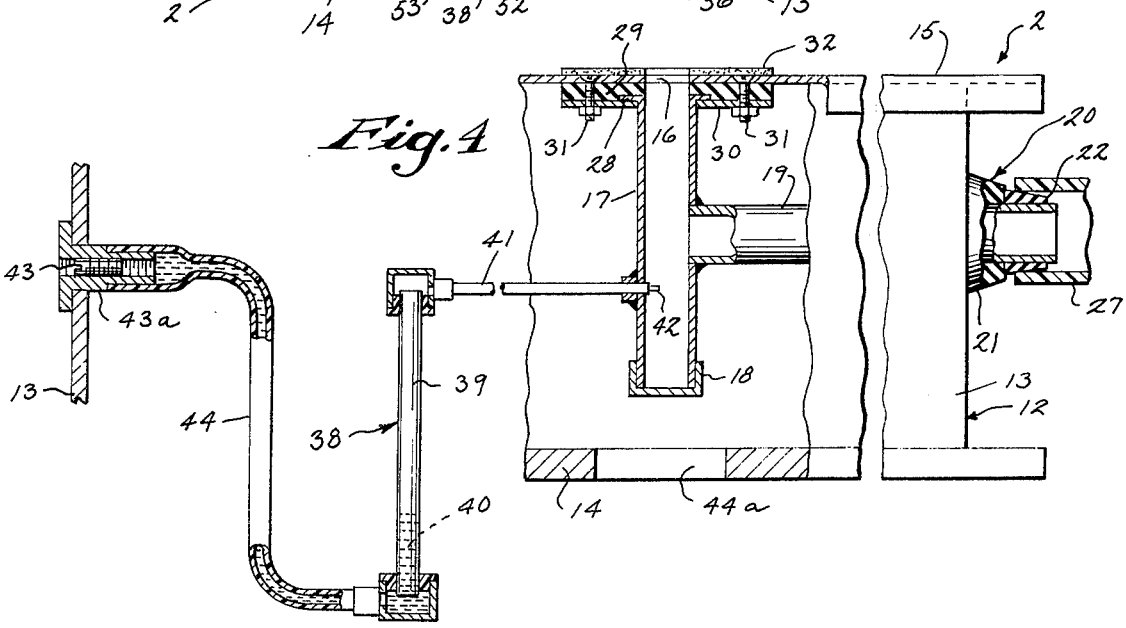
FIG. 4 is a vertical section taken generally on line 4—4 of FIG. 3.

As shown in FIG. 4, conduit 17 is provided with a top flange 28 abutting the underside of a rubber-like washer 29 which abutts the lower surface of the top wall 15. The washer 29 has a concentric opening aligned with the conduit 17. A metal washer 30 and attachment screws 31 rigidly and firmly secure the rubber washer 29 in position and the flange 28 in sealing relationship to seal the vacuum opening. The upper end of the conduit 17 is also spaced from the investment 4 by the upper washer 29 such that heat transfer is minimized. A rubber-like heat resistant pad 32 is secured to the top surface of the top wall 15 to accommodate the kiln-heated investment 4. The pad 32 may advantageously include a rubber with embedded asbestos to provide a flat, supporting surface for the planar bottom wall of the investment cylinder and serves to insulate the housing structure.

The vacuum level created in conduit 17 is preferably adjustable. In the illustrated embodiment of the invention, an exhaust pipe or conduit 33 is joined to the vacuum pipe 19 as by a weld or braze 34 to provide an air tight joint therebetween. The exhaust pipe 33 extends forwardly with the terminal end supported adjacent the front side wall 13 of the housing 12. A valve member 35, such as a simple "spigot" valve, is mounted within the terminal portion of the exhaust pipe 33 and includes a positioning shaft 36 projecting outwardly through the front side wall. A vacuum selection knob 37 is secured to the shaft 36 for selective positioning of the valve 35. The opening and closing of the valve 35 varies the exhaust of the vacuum pressure conduit 19 by generating an alternate air source. With only the vacuum cleaner unit 11 connected to the conduit 19, maximum vacuum air flow and pressure is created. By introducing the alternate air supply, the vacuum created in the vacuum 19 will be reduced in accordance with the well-known leak-port theory of operation.

A vacuum level is shown on a suitable indicator 38 in the illustrated embodiment of the invention. The indicator 38 is a liquid-filled tube 39 mounted on the front side wall of the housing 12. The tube 39 is vertically oriented. The upper surface of the liquid 40 is in the lower portion of the tube 39 with mounting enclosure members having bolt or stud members extending through the front wall and receiving clamping nuts to the opposite side thereof. A uniform number scale is printed along the side of the tube 39 and the relative vacuum created is read by the height of a column of liquid 40 within the tube 39.

The tube 39 is suitably connected by a sensing line 41 to the vertical vacuum conduit 17. The illustrated embodiment includes a small diameter tube 42 located above the incoming line 19 and spaced slightly below the underside of the investment 4. As the vacuum increases within the conduit 17, a corresponding proportionate condition is created in sensing line 41 and the upper end of the indicating tube 39. This results in a rising of the liquid column 40 to provide a direct indication of the relative vacuum pressure.

The initial starting level of the column 40 is controllable to permit adjustment to atmospheric conditions and the like. An initial adjustment screw 43 threaded into the wall mount 43*a* of an extended liquid tube 44 from the lower end of tube 39. The screw 41 is provided with a recess to permit direct adjustment of the initial or starting level of the liquid column 40 in the vacuum indicator tube 39. The indicator is normally adjusted to a zero level prior to initial operation of the casting apparatus.

The bottom cap 18 on the lower end of the conduit 17 defines a catch basin which is accessible through a bottom wall opening 44*a* for the convenient removal of any debris which enters through the vacuum opening. For example, breakdown of a defective investment 4 may occur during the forming operation. The vacuum would, of course, draw particles into the vacuum conduit 17 which, if not removed, would interfere with the desired operation of the apparatus.

The power supply for the vacuum cleaner 11 and for the kiln 10 is conveniently controlled from the vacuum casting apparatus 2 in the illustrated embodiment of the invention. A single main three-way power supply cord 45 is secured to the back wall of the housing with an outer plug 46 for interconnection to the conventional AC supply or the like. A local fuse unit 47 may be incorporated into the main power line. The power cord 45 is connected to a vacuum outlet 48 and to a kiln outlet 49 on the back sidewall 13 of housing 12. The outlets 48 and 49 are of the conventional socket type adapted to receive the usual power line plug of the respective power cords 50 and 51 from a vacuum cleaner unit 11 and electric kiln 10. The connections between the power cord and the respective outlets similarly incorporates a vacuum switch 52 and a kiln switch 53 provided on the front side wall of the housing 12. The switches 52 and 53 are shown as simple toggle switches which are series connected with the one side of the respective outlets from the local fuse unit 47 to the outlets 48 and 49.

In summary, the present invention provides a small, portable-type vacuum casting apparatus which can be conveniently stored for periodic and intermittent use. When a metal object is to be cast, the apparatus is, of course, connected to the output of the vacuum cleaner hose and the power cords for the vacuum cleaner unit 11 and the kiln 10 are connected to the outlets 48 and 49. The pattern or replica is embedded in a forming cylinder 3 and filled with a liquid investment material such as a plaster-of-paris or like material. The investment unit 1 is placed in the kiln 10 and heated to a temperature to fully set the investment and simultaneously to effectively burn-out the replica in accordance with present known technology to create the cavity 5. The heated investment unit is removed and placed directly on the top wall pad 32 of the casting apparatus 2 with the lower surface of the cylinder overlying the vacuum opening. The vacuum switch 52 is turned on at least slightly before placement of the investment cylinder unit 1 on the pad 32 and such that the vacuum is immediately created and applied to the undersurface of the heated investment 4. The molten metal is then immediately poured into the investment cavity 5. The high flow, low level vacuum created and transmitted through the lower end of the investment 4 continuously removes gases and air from within the cavity 5. As a result, the molten metal which is poured into the cavity is not oxidized nor are air pockets formed between the material and the mold surface. Generally the vacuum will be maintained for a minute or more after the pouring of a small object. Thereafter, the investment casting can be removed and allowed to completely solidify after which the investment is broken away leaving the final product. Then the hot investment unit 1 is conventionally immersed in cold water to break the investment. The present invention, which employs a high volume of air flow with a low vacuum pressure rather than attempting to generate a high vacuum pressure, therefore produces a reliable and inexpensive investment casting apparatus. The investment may be supported on the upper flat surface without creation of an enclosing vacuum about the investment sidewalls. Generally, the vacuum source of the present invention creates a vacuum pressure which is significantly less than the normal negative barometric pressure level and with a very significant air flow. Thus, the level will normally be no greater than 800 millimeters (mm) of water gauge and normally of the order of 600 mm $H_2O$ with a flow in excess of $3.9 \times 10^3$ cubic centimeter per second ($CM^3/s$). These limits are typical of the conventional shop or household vacuum cleaners. Generally, the pressure may be within the range of 400 to 800 mm and the flow in the range $1.7 \times 10^3$ to $6.9 \times 10^3$ $CM^3/s$ with completely satisfactory results.

The apparatus may be formed within the broadest concept with a depression of any desired extent within which the investment is located and will still function in accordance with the teaching of the present invention. The flat supporting surface, however, is desirable to most conveniently accommodate various sized investments and to minimize constructional costs.

Further the use of a conventional vacuum cleaner apparatus which is generally readily available significantly minimizes the cost of the investment casting apparatus. The present invention thus provides an improved investment casting apparatus which may be readily adapted to the small shop such as encountered by dentists, small jewelry shops, hobbyists, school and the like.

We claim:

1. An apparatus for investment casting comprising a support having a vacuum opening means located centrally of the support, an investment casting means to be located in overlying relationship to said opening means, and a high volume flow, low pressure level vacuum source having means for establishing a continuous flow and connected to said opening means to create a low level vacuum on the investment casting, said source establishing a vacuum on the order of 600 mm of water gauge and a flow on the order of $3.9 \times 10^3$ $CM^3/s$.

2. The apparatus of claim 1 wherein said vacuum source constitutes a household vacuum cleaner and a hose member terminating in a tubular slip connector, a conduit means secured to said opening means and terminating in a conical shaped input to receive said connector.

3. The apparatus of claim 1 including a vacuum indicator coupled to said opening means, and means to adjust the initial reference reading of the indicator.

4. The apparatus of claim 1 wherein said opening means includes a vertical conduit means having a sidewall vacuum connection intermediate the ends thereof, and a releasable cap means secured to the lower end of said conduit means and defining a catch basin for foreign matter entering said conduit.

5. The apparatus of claim 1 wherein said support includes a housing having a bottom wall and a top wall defining a planar surface, said housing including a sidewall, a conduit means in said housing connected to said central opening and having a vacuum connection and an exhaust connection including an adjustable valve means.

6. An apparatus for investment casting comprising a support having an upper surface with a vacuum opening means and a high volume flow, low pressure level vacuum source connected to said opening means and operable to establish a continuous flow with a pressure on the investment casting slightly below atmospheric pressure, said support includes a housing having a bottom wall and a flat top wall defining said planar surface, said housing including a sidewall, a conduit means in said housing connected to said top wall and defining said opening means and having a tubular vacuum connector in a rear sidewall and an exhaust tube terminating at the front sidewall, said exhaust tube including an adjustable valve means, a vacuum control mounted in said sidewall and connected to said valve means, said vacuum source constitutes a household vacuum cleaner and a hose member terminating in a tubular slip connector, said tubular connector secured to said opening means and terminating in a conical shaped input to receive said slip connector.

7. The apparatus of claim 6 including a vacuum indicator tube secured at the opposite ends to the support and containing a liquid column, a supply conduit secured to the lower end of the tube and to the support, an axially adjustable closure member secured to the outer end of the supply conduit for adjusting the initial position in the lower end of the indicator tube, and a vacuum signal conduit connected to the upper end of the indicator tube and to said opening means.

8. The apparatus of claim 6 wherein said conduit means includes a vertical conduit having a vacuum connection intermediate its upper and lower end terminating in an outer exterior connecting tube, said connector including a pair of axially offset conically-shaped resilient members slidably secured on the connecting tube.

9. The apparatus of claim 6 wherein said conduit means includes a vertical conduit having a vacuum connector intermediate the opposite ends, and a releasable cap means secured to the lower end of the vertical conduit and defining a releasable catch basin.

10. The apparatus of claim 6 wherein said conduit means includes a vertical conduit having a vacuum connection intermediate its upper and lower end terminating in an outer exterior connecting tube, said connector including a pair of axially offset conically-shaped resilient members slidably secured on the connecting tube, a releasable cap means secured to the lower end of the vertical conduit and defining a releasable catch basin, a vacuum indicator tube secured at the opposite ends to the support and containing a liquid column, a supply conduit secured to the lower end of the tube and to the support, an axially adjustable closure member secured to the outer end of the supply conduit for adjusting the initial position in the lower end of the indicator tube, and a vacuum signal conduit connected to the upper end of the indicator tube and to said opening means.

* * * * *